United States Patent [19]

Reuss

[11] Patent Number: 4,771,262

[45] Date of Patent: Sep. 13, 1988

[54] ROTARY POTENTIOMETER DRIVE MEANS

[75] Inventor: Oswald Reuss, Unterelsbach, Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 36,852

[22] Filed: Apr. 10, 1987

[30] Foreign Application Priority Data

Apr. 15, 1986 [DE] Fed. Rep. of Germany ..... 3612574

[51] Int. Cl.[4] ..... H01C 10/32

[52] U.S. Cl. ..... 338/162; 338/184

[58] Field of Search ..... 338/162, 163, 164, 174, 338/184, 199

[56] References Cited

U.S. PATENT DOCUMENTS

| | | | |
|---|---|---|---|
| 3,446,085 | 5/1969 | Ginsberg | 338/174 X |
| 3,469,225 | 9/1969 | Wood | 338/163 |
| 4,357,591 | 11/1982 | Gray | 338/162 |
| 4,701,740 | 10/1987 | Reuss et al. | 338/164 |

FOREIGN PATENT DOCUMENTS 3444229 6/1986 Fed. Rep. of Germany .

OTHER PUBLICATIONS

"Elektronischer Vergaser Serienreif", Krafthand, vol. 15, Aug. 1983, pp. 877–881.

*Primary Examiner*—C. L. Albritton

*Attorney, Agent, or Firm*—Woodcock Washburn Kurtz Mackiewicz & Norris

[57] ABSTRACT

A drive means of a rotary potentiometer is arranged to work trouble-free in the case of misalignment between the rotary axis of the rotating body and the rotary axis of the driving member. Teeth are arranged in the rotating, or rotary body, the crests of which teeth are directed to the rotary axis. The driving member is adjacent to the one flank of the one tooth and the one flank of the other tooth. The flanks of the teeth are involutely rounded off, so that the applied torque remains substantially constant in event of any misalignment of the driving member axis with respect to the body axis.

12 Claims, 1 Drawing Sheet

ROTARY POTENTIOMETER DRIVE MEANS

FIELD OF THE INVENTION

The present invention relates to a drive means of a rotary potentiometer and more particularly, a driving member for engaging a body of revolution or rotary body which in turn supports a potentiometer-sliding contact.

BACKGROUND OF THE INVENTION

A rotary potentiometer of that type that has a driving member is used, for example, in an electronic carburetor of a motor vehicle (cf. Krafthand, Vol. 15, Aug. 6, 1983, p. 877 to 881). In such application, the control of the mixture concentration during starting, running up and acceleration is effected electronically. The air/fuel ratio is influenced by means of a throttle valve. A throttle valve rotary potentiometer serves for determining the position and the sequence of motion of the throttle valve, which throttle valve potentiometer is connected with the throttle shaft by means of a coupling.

In W. German patent application No. P 34 44 229.4 and U.S. Pat. No. 4,701,740, a rotary potentiometer of the above type is described. In this case, the rotary body, i.e., the body being driven to rotate, has a depression, at the inner edge of which two teeth offset by 180° are provided, the crests of which teeth are directed to the rotary axis. The flanks of the teeth, which are designed to be engaged by a drive means when the body is to be turned, are flat-shaped, i.e., they present flat surfaces to the drive member which engages them. This arrangement is disadvantageous because some slight axle misalignment between the rotary body and the driving means is unavoidable, in which case different torque ratios may result. This results in the force being necessary for driving the rotary body of revolution to vary.

SUMMARY OF THE INVENTION

It is an object of the present invention to provide a drive means of a type where the functioning is not affected in the case of a misalignment of the rotary axis of the rotated body and the rotary axis of the driving member.

The above object is solved according to the present invention by a drive means wherein a rotary body carries a pair of teeth in opposed positions with respect to the rotary axis, which teeth are aligned parallel to the rotary axis, with a driving member being adjacent to one flank of a first tooth and to one flank of the opposite tooth, and that the tooth flanks against which the driving member bears are involutely rounded off.

Due to the design of this invention, in the case of a misalignment of the rotary axis of the driving member with respect to the rotary axis of the rotary body, the ratios of contact of the driving member at the teeth are maintained substantially equal, such that there are no considerable variations of the torque. Specific measures to remedy the misalignment of the rotary axis are thus unneeded, providing a substantial advantage over the prior art.

Preferred embodiments of the present invention will appear or be suggested from the claims, the following description of an example of a preferred embodiment, and the accompanying drawings.

DETAILED DESCRIPTION OF THE INVENTION

Figure 1:
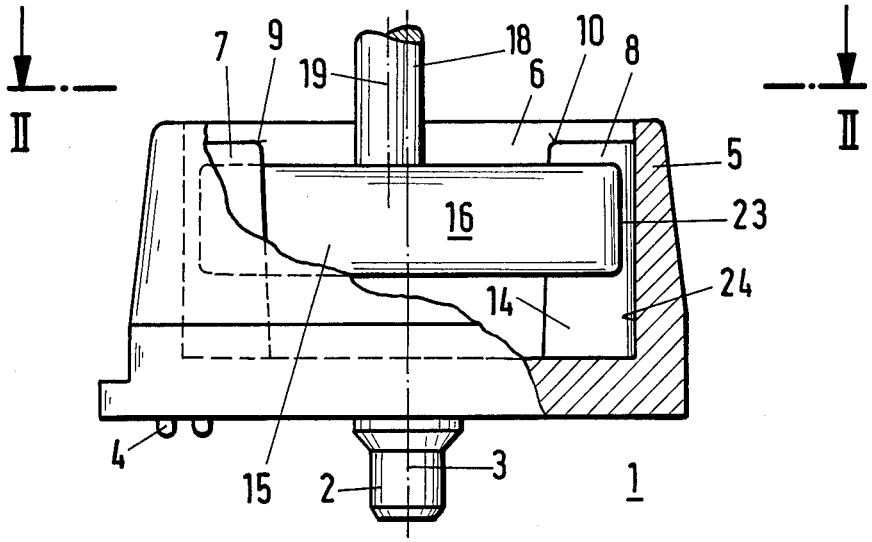
FIG. 1 is a partial section view of a rotary body of a rotary potentiometer.

The rotary body 1 comprises an axle member 2, with which the rotary body 1 is rotatably supported around the axis 3 at the baseplate not shown. At the bottom side 4 a resilient potentiometer-sliding contact, not shown, is fixed, which upon rotation of the rotary body 1 slides over a resistive film provided on the baseplate.

The rotary body 1 comprises a sleeve-type stud 5, the interior 6 of which is substantially cylindrical. At the stud 5, two axially extending teeth 7 and 8 are formed in the interior 6. The crests 9, 10 of the teeth are directed to the rotary axis 3; as seen in the Figures, the teeth extend substantially parallel to the axis 3. The teeth 7 and 8 are offset by 180° in the interior 6; that is, they are standing opposite each other with respect to the rotary axis 3. The flanks of the teeth 11, 12, 13 and 14 are involutely rounded off (cf. FIG. 2). In the axially extending central range, the flanks of the teeth 11, 12 and 13, 14, respectively, are disposed on a circle K.

Figure 2:
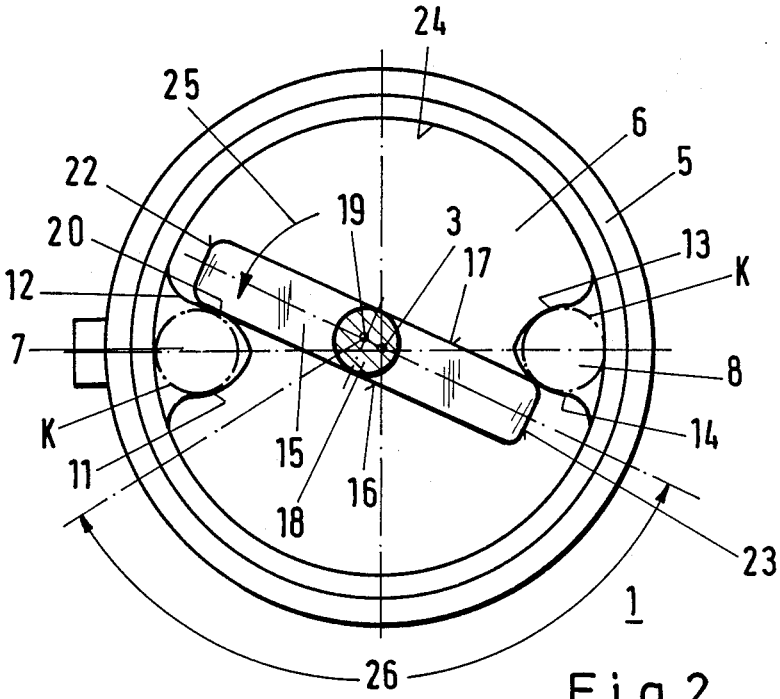
FIG. 2 is a top view along the line II—II according to FIG. 1.

For driving the rotary body 1, a driving member 15 is provided, which is formed by a cuboid-shaped bolt comprising parallel side surfaces 16 and 17. The driving member 15 is disposed on a shaft 18 having a rotary axis 19. In practice, the rotary axis 19 will rarely be in exact alignment with the rotary axis 3. The rotary axis 19 may be offset with respect to the rotary axis 3 as illustrated in FIG. 2, and/or be disposed at an angle thereto.

In the position as shown in the figures, the driving member 15 is in contact with the circular central range of the tooth flank 12 with the one end range 20 of its side surface 16. The opposite end range 21 of the side surface 17 is in contact with the circular central range of the tooth flank 14. The length of the driving member 15 is smaller than the diameter of the interior 6. Thus, there are distances between the end faces 22 and 23 of the driving member 15 and the inner circumference 24 of the interior 6, which distances are dimensioned such that the end faces 22, 23 will not touch the inner circumference 24 in each case of a misalignment between the rotary axis 19 and the rotary axis 3 to be taken into consideration.

When the driving member 15 is rotated around the rotary axis 19 in the direction of the arrow 25, it presses on the flanks of the teeth 12 and 14, thus causing the rotary body 1 to rotate around the rotary axis 3. In the case of a misalignment between the rotary axes 19 and 3, at least one of the end ranges 20, 21 will, during the entire rotary motion, remain in contact with the relevant flank of the tooth 12 or 14, respectively. The point of contact at the flank of the tooth 12 or 14, respectively, thereby does not virtually change. The same applies in the case of different misalignments from that illustrated. The torque which the driving member 15 must produce for driving the rotary body 1 thus remains substantially constant during the entire rotary motion, so that, in spite of the axle misalignment, a jerk-free, continuous drive is achieved.

When turned in the direction of the arrow 25, the driving member 15 acts against the virtually constant elastic force of a return spring (not shown) engaging the rotary body 1. In both directions of motion of the driving member 15, the end ranges 20, 21, upon displacement of said driving member 15, due to the elastic force, are constantly in contact with the relevant tooth flank 12, 14 of the tooth 7, 8. Through the whole range of rotation of the driving member 15, which is smaller than 120° and is generally dimensioned to be about 90°, there is thus a blacklash-free, synchronous movement to and fro of the body of revolution 1 and the driving member 15.

If the rotary body 1 is to be rotated in counterdirection to the arrow 25 without the action of a return spring, the driving member 15 is first rotated around an idle stroke 26, until the side surface 16 strikes the central range of the flank of the tooth 11 and the side surface 17 strikes the central range of the flank of the tooth 13. Then, the body of revolution 1 is again taken along backlash-free. The angle of the idle stroke 26 can be decreased by increasing the width of the teeth 7 and 8 at the circumference of the interior 6. The angle of the idle stroke 26 can also decreased by providing a further pair of teeth.

It is sufficient to form merely those flanks of the teeth rounded off, as described, which are provided for being contacted with a side surface of the driving member 15.

We claim:

1. A drive means of a rotary potentiometer, comprising a rotary body rotatable around a first rotary axis, said rotary body supporting a potentiometer-sliding contact, and a driving member positioned to drive a said rotary body, characterized in that said rotary body comprises a pair of oppositely positioned teeth, each tooth having a crest and an involutely rounded off flank, the crests of said teeth being directed to the first rotary axis, and in that the driving member is rotatable around a second rotary axis and further comprises parallel side surfaces, said first rotary axis substantially parallel to said second rotary axis, wherein the parallel side surfaces of the driving member is positioned to contact the flank of each of said teeth when driving said rotary body.

2. A drive means according to claim 1, characterized in that the flanks of each of said teeth are disposed in their central range on a circle.

3. A drive means according to claim 1 or 2, characterized in that two teeth are provided being offset of 180° with respect to the rotary body axis.

4. A drive means of a rotary potentiometer, comprising a rotary body rotatable around a rotary axis, said rotary body supporting a potentiometer-sliding contact, and a driving member positioned to drive said rotary body, characterized in that said rotary body comprises a pair of oppositely positioned teeth, each tooth having a crest, the crests of said teeth being directed to the rotary axis, an involutely rounded off flank and a sleeve-type stud, said teeth formed at the inner circumference of said sleeve-type stud, wherein the driving member is positioned to contact the flank of each of said teeth when driving said rotary body.

5. A drive means according to claim 4, wherein said driving member is rotatable around a second rotary axis and characterized in that the length of said driving member is less than the diameter of said sleeve-type stud by at least twice the axial misalignment between the rotary axis of the rotary body and the rotary axis of the driving member.

6. A drive means according to claim 1, characterized in that in case of a reversal of rotation, said rotary body remains in contact with the driving member.

7. A drive means of a rotary potentiometer, comprising a rotary body rotatable around a rotary axis, said rotary body supporting a potentiometer-sliding contact, and a driving member positioned to drive said rotary body, characterized in that said rotary body comprises a pair of oppositely-positioned teeth, each tooth having a crest, the crests of said teeth being directed to the rotary axis, and an involutely rounded off flank, and in that the driving member is rotatable around a second rotary axis and further comprises parallel side surfaces, wherein the driving member is positioned to contact the flank of each of said teeth when driving said rotary body and wherein in case of a reversal of rotation, the driving member carries out an idle stroke.

8. A drive means according to any one of the preceding claims, characterized in that more than two teeth are arranged at the inner circumference of the rotary body.

9. The rotary potentiometer drive means, comprising a rotary member adapted to rotate around a first axis and for carrying a potentiometer contact, drive means adapted for rotating around a second axis for rotatably driving said rotary member, said rotary member having at least one pair of teeth members haviang rounded surface portions, said driving means being positioned to bear against at least one of said tooth members to impart torque to said rotary member, said drive means having substantially flat contact surfaces at each end thereof for bearing against a respective one of said tooth members, whereby the torque applied is substantially unvaried in the case of misalignment of said first and second axes and wherein said first and second axes are substantially parallel.

10. The potentiometer drive means as described in claim 9, wherein said tooth members are involutely rounded off.

11. The potentiometer drive means as described in claim 9, wherein said tooth members have substantially circular central surfaces for receiving said drive means.

12. The potentiometer drive means as described in claim 11, wherein said drive means comprises a cuboid-shaped member having parallel side surfaces for engaging said tooth members.

* * * * *